United States Patent [19]

Daniels

[11] Patent Number: 5,029,911

[45] Date of Patent: Jul. 9, 1991

[54] LOCKING THRESHOLD

[76] Inventor: Duane C. Daniels, 1407 S. Florence Ave., Tulsa, Okla. 74104

[21] Appl. No.: 523,712

[22] Filed: May 16, 1990

[51] Int. Cl.[5] ..... E05L 9/02

[52] U.S. Cl. ..... 292/170; 292/DIG. 15; 49/467; 49/316; 49/394

[58] Field of Search ..... 49/304, 305, 306, 307, 49/308, 467, 468, 472, 394, 316; 292/DIG. 15, 170; 16/82 R

[56] References Cited

U.S. PATENT DOCUMENTS

| | | | |
|---|---|---|---|
| 2,541,421 | 2/1951 | Hunter | 49/305 |
| 3,123,870 | 3/1964 | Coe | 49/304 |
| 3,330,585 | 7/1967 | Pollin | 292/DIG. 15 |
| 4,156,325 | 5/1979 | McMullen | 49/468 |

*Primary Examiner*—Eric K. Nicholson

*Attorney, Agent, or Firm*—Head & Johnson

[57] ABSTRACT

A locking door threshold having an elongated vertical slot within the upper surface, an elongated striker bar received in the slot, the striker bar being vertically slidable within the slot between a lower position and an upper position in which the striker bar intercepts a door pivoted over the threshold, and a slide bar positioned within the slot and below the striker bar, the slide bar being horizontally slidable between a first and second position, the surfaces of the slide bar and the locking bar interrelating so that when the slide bar is in one position the locking bar is elevated to prevent opening of the door and when in the second position the locking bar is vertically lowered in the threshold slot to permit the door to be opened. A locking lever extending from the threshold and connected to the slide bar is used to control the position of the slide bar.

11 Claims, 2 Drawing Sheets

10
12
14
16
18
20
22
24
26
28
30
30A
30B
32
34
36
38
40
42
44
46
48
52
56
62
3
4

LOCKING THRESHOLD

SUMMARY OF THE INVENTION

This disclosure relates to an improved and effective means of locking a door in a closed position.

Many devices exist for holding a door in a closed position. The standard means is by use of a lock secured to the edge of the door opposite the pivoted edge, the lock having a retractable plunger that, when in the locked position, extends from the door into the door jam. For improved security, deadbolt locks are employed having a plunger that can be removed only when a mechanism is rotated, the mechanism being controlled by a key from the exterior of the door and by a knob on the interior of the door.

Such usual door locking means is satisfactory for locking a door against inadvertent opening and to resist the forces of weather and so forth. However, such devices are not totally effective against forceful intrusion. Since the typical door lock is in the form of a plunger extending from the edge of the door opposite the pivoted edge into the door jam, all of the effective areas resisting opening of the door are concentrated in a very small space, that is, at the point where the plunger extends from the door into the jam. Most doors held by a typical door lock, and even including those held by a deadbolt lock, do not effectively resist the application of force, such as by a hard kick by a heavy man against the door at the point where the locking plunger extends from the door. The application of sudden force in this area will usually split the door jam or the area of the door surrounding the lock. This is particularly true since relatively large openings must be provided in the door to receive the lock leaving only relatively thin material on either side of the locking mechanism.

The present device is a highly improved and effective means of locking a door against forcible entry. The locking mechanism of this disclosure is in the form of an improved threshold. Thresholds are commonly employed for exterior doors and are usually made of wood or metal. Thresholds provide a raised seal at the bottom of the door opening so that the door, when in the closed position, is sealed against the passage of air therepast. The use of a threshold allows the door bottom to be spaced above the height of the floor of the room into which the door opens so that the bottom of the door will clear rugs or carpets on the floor.

The threshold of this disclosure is, in external appearance, substantially similar to metal thresholds commonly used in buildings today, and the external cross-sectional configuration is not unlike standard wooden thresholds which have been used for centuries. The threshold of this disclosure is preferably made of metal and can be effectively formed of extruded aluminum. The threshold is an elongated device fitting across the full length of a door opening and of short elevational height. The threshold has an elongated slot therein extending substantially the full length of the threshold. In addition, the threshold has a weather strip formed of compressible material received in the threshold upper surface adjacent to and parallel the elongated slot. The weather strip is positioned with respect to the door so that when the door is in the closed position, the weather strip fits compressibly and sealably against the door lower edge. The slot, with respect to the weather strip, is interiorly of the inner edge of the door when the door is closed. The slot is thus parallel to and spaced from the weather strip.

Received within the vertical slot is an elongated striker bar. The striker bar has an upper edge and is vertically slidable within the slot between a lower and an upper position. In the upper position the upper edge is below the bottom edge of the pivotal door and, preferably, substantially coincident with the threshold upper surface. In the upper position the upper edge extends above the door lower edge. In the upper position the striker bar interfers with opening of the door.

Slidably received within the threshold elongated slot and below the striker bar is a slide bar. The striker bar has a bottom edge configured to rest upon the upper edge of the slide bar. The striker bar lower edge has portions inclined at an acute angle relative to the horizontal length of the slide bar and in like manner, the upper edge of the slide bar has portions inclined at an acute angle relative to the horizontal length of the slide bar. These inclined surfaces are mating with each other so that when the slide bar is in one position, the striker bar is raised, and in another position, the striker bar is lowered.

In the preferred arrangement of this door locking threshold device, a locking lever extends from the threshold and is moveable between a locked and unlocked position. The locking lever is attached to the slide bar so that when the locking lever is moved in one direction, the slide bar is moved to raise the striker bar, and when the locking lever is moved in the other direction, the slide bar is moved to lower the striker bar.

The locking threshold mechanism of this disclosure thereby provide a striker bar which, when in the door locked position, that is, when the striker bar is raised above the upper surface of the threshold, an impediment to opening the door is applied across substantially the full width of the door. Therefore, any effort to forcibly open the door is resisted not by the door jam or not by an area of weakness at a point at which a lock is installed in the door, but across the full door bottom. In order to forcibly open a door with the threshold locking member in the locked position, forcible intrusion would require that the door be substantially destroyed, requiring significant physical force greatly in access of that which is required to forcibly open a door secured only by a typical locking mechanism, such as a deadbolt lock.

Others have provided door locking mechanisms for engaging the door when it is in a closed position and for reference to such other locking devices, see the following U.S. Pat. Nos. 1,271,363; 3,805,322; 3,833,963; 4,303,266; 4,343,500; 4,462,623; 4,631,776; 4,678,213; 4,797,970.

A better understanding of the disclosure will be had by reference to the following description and claims, taken in conjunction with the attached drawings.

DESCRIPTION OF THE DRAWINGS

FIG. 3 shows the locking threshold only and does not show any portion of the door or the door passageway in which the threshold is used.

DESCRIPTION OF THE PREFERRED EMBODIMENT

Figures 1, 2, 3, 4:
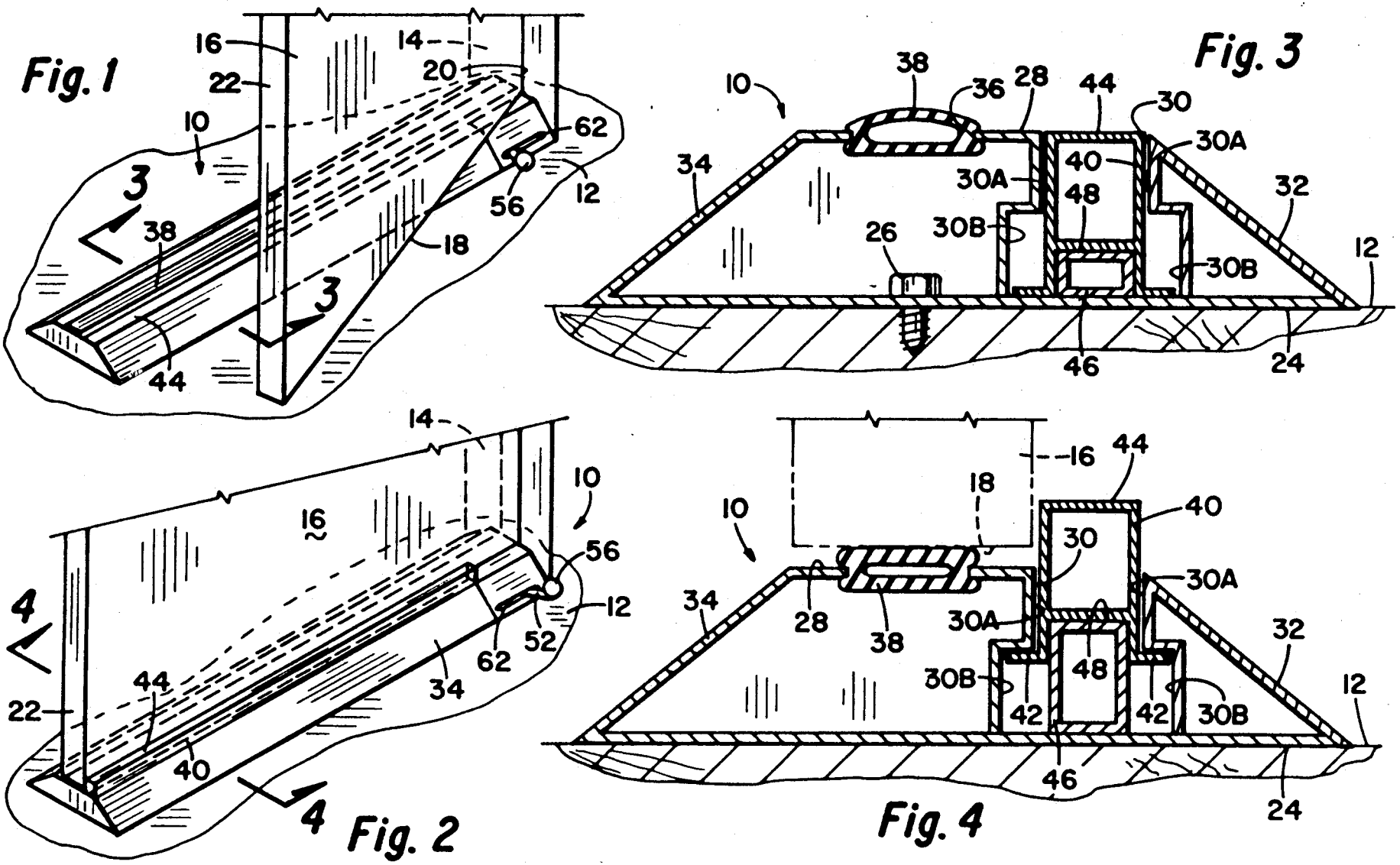
FIG. 1 is an isometric view showing the locking threshold of this disclosure positioned in a door passageway having a door therein in which the lower portion of the door is shown, the door being ajar and the locking threshold in the unlocked position.
FIG. 2 is an isometric view as in FIG. 1 but showing the door in the closed position and with the locking threshold in the door locked position.
FIG. 3 is a cross-sectional view of the locking threshold as taken along the line 3—3 of FIG. 1.
FIG. 4 is a cross-sectional view taken along the line 4—4 of FIG. 2 and is substantially similar to that of FIG. 3 but shows the locking threshold in the locked position and with the lower portion of a door shown in dotted outline, with the door in the closed position.

Referring to the drawings and first to FIGS. 1 and 2, the locking threshold is generally indicated by the numeral 10. The threshold 10 is positioned on a floor surface 12 in a door passageway, one vertical surface of the door passageway being indicated by the numeral 14, the opposite surface not being shown so as to reveal more details of the threshold. Pivotally secured within the door passageway 14 is a door 16. The door has a lower edge 18, a first vertical edge 20 which is pivoted to the door passageway 14, and an opposite or unpivoted vertical edge 22. Threshold 10 is positioned below door lower edge 18 in a way that a threshold is normally employed in building construction.

As shown in the cross-sectional view in FIGS. 3 and 4, threshold 10 is illustrated as being preferably formed of extruded metal, such as extruded aluminum and may be substantially unitary when formed of an extrusion. The threshold 10 has a bottom surface, 24 that rests on floor surface 12. The threshold is bolted securely to the bottom surface such as by threaded lag screw 26, only one of which is shown in FIG. 3, but which are preferably spaced at even intervals along the full length of the threshold.

Threshold 10 has a top surface 28. Formed in the top surface is an elongated slot 30 which extends substantially the full length of the threshold. The threshold is further defined by an inclined inner edge 32 and inclined outer edge 34 that connects the portion having top surface 28 with the portion having bottom surface 24.

The top surface 28 includes an elongated weather strip slot 36 which is parallel to and spaced from the first mentioned slot 30. Weather strip slot 36 receives an elastomeric strip member 38 that may have a cross-section, such as shown in FIG. 3, in the normal state. The weather strip 38 is held within weather strip slot 36 by the natural resiliency of the weather strip and is removable from slot 36 when desired, such as for replacement, or to facilitate installation of the locking threshold. FIG. 3 shows weather strip 38 in its normal expanded condition, and FIG. 4 shows door 16 in a closed position so that bottom edge 18 presses against weather strip 38 to slightly compress it thereby forming an air-lock weather seal against the door bottom edge. It can be seen that weather strip 38 when removed from weather strip slot 36 provides exposure for installation of lag screws 26 when the threshold is mounted in a building doorway.

The vertical slot 30 formed in the threshold in the illustrated embodiment is formed of parallel upper opposed sidewalls 30A and parallel lower sidewalls 30B. The sidewalls 30A and 30B are vertical and spaced apart from each other, the spacing between lower sidewall 30B being greater than that between upper sidewall 30A.

Vertically slidably received within slot 30 is an elongated striker bar 40. In the illustrated arrangement, striker bar 40 is in the shape of an elongated extrusion that is hollow in portions thereof as seen in FIGS. 3 and 4, but which could equally as well be formed of a solid bar. The striker bar has outwardly extending flanges 42 on the bottom edge thereof, the flanges extend outwardly into the portion of the vertical slot defined by lower sidewalls 30B. Flanges 42 serve to limit the upward displacement of the striker bar.

Figure 5:
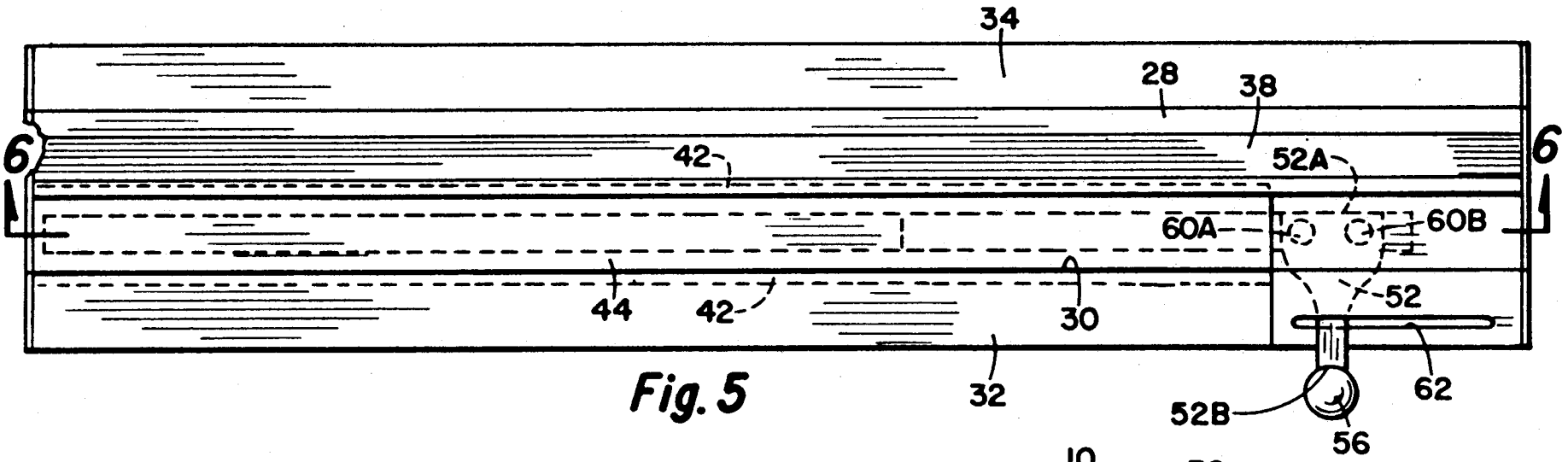
FIG. 5 is a top plan view of the locking threshold as shown in FIGS. 1–4.
Figure 6:
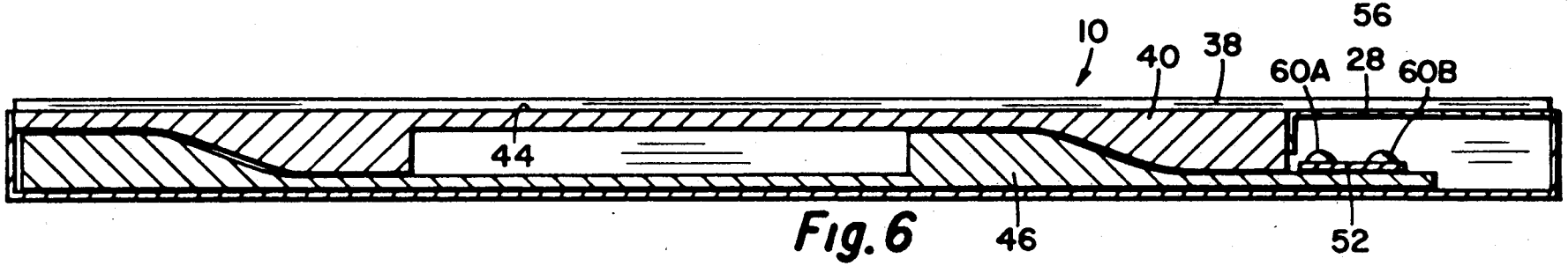
FIG. 6 is an elevational cross-sectional view taken along the line 6—6 of FIG. 5 and showing the internal mechanisms of the locking threshold in the unlocked position.
Figure 7:
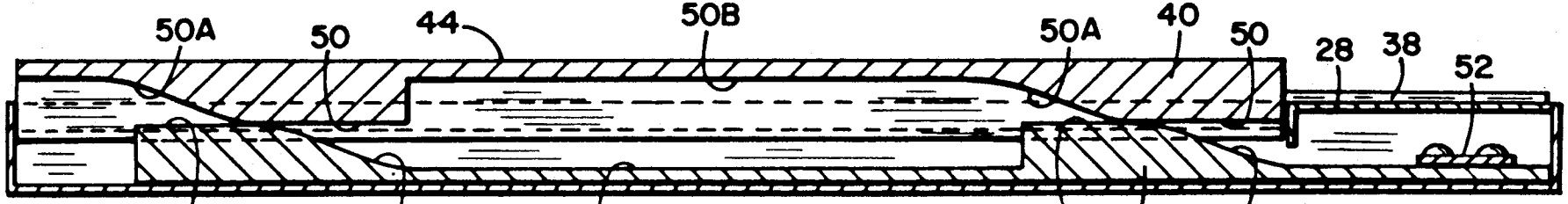
FIG. 7 is an elevational cross-sectional view as in FIG. 6 but showing the locking threshold in the locked position.

FIGS. 5, 6 and 7 show more details of the striker bar. The striker bar has an upper or top edge 44. When the striker bar is in its downward position as shown in FIG. 6, upper edge 44 is preferably substantially coincident with the threshold top surface 28.

Slidably positioned below the striker bar within slot 30 is a slide bar 46. As shown in FIGS. 3 and 4, this slide bar 46 is shown in part to be hollow, although it can readily be a solid member.

The slide bar has an upper edge 48 which as shown in FIGS. 6 and 7, has spaced apart inclined surfaces 48A. Between the inclined surfaces 48A is an area where the top edge is of reduced height, such area being indicated by 48B. The slide bar rests on the interior bottom of the threshold within slot 40 and does not move vertically, that is, elevationally, but does move longitudinally within the slot.

Striker bar 40 has a lower edge 50 that has spaced apart inclined areas 50A. Between the inclined areas 50A, the striker bar has a lower edge 50B that is of increased height relative to lower surface 50.

The inclined areas 48A of the slide bar mate with and co-act with the inclined areas 50A of the striker bar. When the striker bar is in the door unlocked position, as shown in FIG. 6, that is, when the striker bar is slidably positioned toward the left of threshold 10 of FIG. 6, striker bar 40 is free to fall vertically downwardly within the slot so that the top edge 44 is substantially coincident with the threshold top surface 28. However, when the slide bar is slid toward the right of the threshold, as in FIG. 7, the inclined surfaces 48A meshing with the striker bar inclined surfaces 50A force striker bar 40 upwardly to the door locked position so that the striker bar top edge 44 extends substantially above the threshold upper surface 28.

It can be seen that when the striker bar is in the upward position, as shown in FIGS. 4 and 7, door 16 cannot be opened since substantially the entire bottom door lower edge 18 is obstructed by striker bar 40. However, when the striker bar is in the downward position, as shown in FIGS. 3 and 6, the door is free to open and close above the threshold in the manner in which a door typically functions with respect to a threshold.

FIGS. 5, 6 and 7 show a means of moving the slide bar between the door locked and unlocked positions. This is accomplished by use of a locking lever 52 having an inner end 52A, and an outer end 52B having a knob 56 thereon.

By means of pins 60A and 60B, the locking lever inner end 52A is attached to slide bar 46.

A slot 62 is formed in the threshold inclined inner edge 32 adjacent the threshold bottom surface 24 which receives locking lever 52.

When the striker bar 40 is in the downward or unlocked position, as shown in FIGS. 1, 3 and 6, the threshold functions in the normal manner as any threshold portioned beneath a door. The threshold provides a seal by means of weather strip 38 against the bottom edge of the door and permits the door bottom edge 18 to be above floor surface 12 to clear carpet and so forth, and the user would perceive no substantial difference in the function of the threshold compared to existing type thresholds used in building practices today.

When the user desires to lock the door in the closed position, all that is required is that knob 56 be slid to the right (with door 16 in the closed position). This action elevationally raises striker bar 40 to the position as shown in FIGS. 2, 4 and 7, thereby securely locking the door. The improved locking threshold is unobtrusive in its normal use. In addition, when locking bar 40 is in the upward position, that is, in the door locked position, the locking bar serves as a further shield against the passage of air below the door bottom edge 18. While in the illustrated embodiment, the striking bar does not extend the full length of threshold 10, it can be configured to extend the full length since all that is required is that a portion thereof cantilever outwardly over the locking lever 52 and linkage system connecting the locking to the sliding bar and in which case slot 30 also extends the full length of the threshold.

The claims and the specification describe the invention presented and the terms that are employed in the claims draw their meaning from the use of such terms in the specification. The same terms employed in the prior art may be broader in meaning than specifically employed herein. Whenever there is a question between the broader definition of such terms used in the prior art and the more specific use of the terms herein, the more specific meaning is meant.

While the invention has been described with a certain degree of particularity it, is manifest that many changes may be made in the details of construction and the arrangement of components without departing from the spirit and scope of this disclosure. It is understood that the invention is not limited to the embodiments set forth herein for purposes of exemplification, but is to be limited only by the scope of the attached claim or claims, including the full range of equivalency to which each element thereof is entitled.

What is claimed is:

1. For use in a building having a passageway with a door for pivotally opening or closing the passageway, the door having a vertical edge, a horizontal bottom edge and an inner vertical surface, the door being pivoted to the building at the vertical edge and inner vertical surface to swing inwardly in the direction of the inner surface to open the door and to swing in the direction opposite the inner surface to close the door, a locking device for the door which does not require modification of the door, comprising:

a horizontal threshold which may be secured to a building in a passageway, the threshold having an upper surface, the height of the threshold being slightly less than the height of the bottom edge of a pivotal door secured to the passageway, the threshold having an elongated vertical slot therein communicating with said upper surface;

an elongated striker bar received in said slot in said threshold, the striker bar having an upper horizontal edge and being vertically slidable within said slot between a lower position wherein the upper edge is below the bottom edge of a pivotal door, and an upper position in which said upper edge is above the door lower edge, the striker bar extending exterior of a door and adjacent and parallel to a door inner vertical surface and displaced from and exteriorly of a door bottom edge when a door is in the closed position to thereby prevent a door from swinging inwardly to the open position; and means of vertically positioning said striker bar.

2. A door locking device according to claim 1 including:

a slide bar positioned within said slot in said threshold below said striker bar, the side bar being horizontally slidable within said slot between a first position and second position, the striker bar having a lower edge and the slide bar having an upper edge, the configuration of such edges providing means of vertically positioning said striker bar whereby in said slide bar first position said striker bar is moved to said upper position and in said slide bar second position said striker bar is moved to said lower position.

3. A door locking device according to claim 2 wherein said slide bar upper edge is defined in part by portions inclined at an acute angle relative to the horizontal length of said slide bar and wherein said striker bar lower edge is defined in part by portions inclined at an acute angle relative to the horizontal length of said striker bar, said slide bar and striker edge portions matching to provide means to vertically position said striker bar when said slide bar is slidably displaced.

4. A door locking device according to claim 2 including:

a locking lever having an inner and an outer end, the lever inner end being secured to said threshold, the outer end extending exteriorly of said threshold whereby movement of said locking lever longitudinally displaces said slide bar between said first and second positions.

5. A door locking device according to claim 1 including:

a slide bar positioned within said slot in said threshold and being horizontally slidable within said slot between a first position and a second position;

means positionally coupling said slide bar to said locking bar whereby in said slide bar first position said locking bar is in said lower position and in said second position said locking bar is in said upper position.

6. For use in a building having a passageway with a door for pivotally opening or closing the passageway, the door having a vertical edge, a horizontal bottom edge, and an inner vertical surface, the door being pivoted to the building at its vertical edge and inner vertical surface, a door locking device, comprising:

a horizontal threshold that may be secured to a building passageway, the threshold having an upper surface, the height of the threshold being slightly less than the height of the bottom edge of a pivotal door secured to the passageway, the threshold having an elongated vertical slot therein communicating with said upper surface;

an elongated striker bar received in said slot in said threshold, the striker bar having an upper horizontal edge, the striker bar being vertically slidable within said slot between a lower position wherein the upper edge is below the bottom edge of a pivotal door, and an upper position in which said upper edge is above, exteriorly of and displaced from a door bottom edge and parallel to and adjacent a door inner vertical surface;

a slide bar positioned within said slot in said threshold and below said striker bar and being horizontally slidable within said slot between a first position and a second position; and means positionally coupling said slide bar to said striker bar whereby in said slide bar first position said striker bar is in said lower position and in said slide bar second position said striker bar is in said upper position.

7. A door locking device according to claim 6 wherein said slide bar positioned within said slot in said threshold is below said striker bar, the striker bar having a lower edge and the slide bar having an upper edge, the configuration of such edges providing means of vertically positioning said striker bar whereby in said slide bar first position said striker bar is moved to said upper position and in said slide bar second position said striker bar is moved to said lower position.

8. A door locking device according to claim 7 wherein said slide bar upper edge is defined in part by portions inclined at an acute angle relative to the horizontal length of said slide bar and wherein said striker bar lower edge is defined in part by portions inclined at an acute angle relative to the horizontal length of said striker bar, said slide bar and striker edge portions matching to provide means to vertically position said striker bar when said slide bar is slidably displaced.

9. A door locking device according to claim 6 including: a locking lever having an inner and an outer end, the lever inner end being secured to said threshold, the outer end extending exteriorly of said threshold whereby movement of said locking lever longitudinally displaces said slide bar between said first and second positions.

10. For use in a building having a passageway with a door for pivotally opening or closing the passageway, the door having a vertical edge and horizontal bottom edge, the door being pivoted to the building at the vertical edge, a door locking device, comprising:

a horizontal threshold which may be secured to a building in a passageway, the threshold having an upper surface, the height of the threshold being slightly less than the height of the bottom edge of a pivotal door secured to the passageway, the threshold having an elongated vertical slot therein communicating with said upper surface;

an elongated striker bar received in said slot in said threshold, the striker bar having an upper horizontal edge, the striker bar being vertically slidable within said slot between a lower position wherein the upper edge is below the bottom edge of a pivotal door, and an upper position in which said upper edge is above the door lower edge, said striker bar having a lower edge defined in part by portions inclined at an acute angle relative to the horizontal length thereof; and a slide bar positioned within said slot in said threshold below said striker bar, the side bar being horizontally slidable within said slot, the slide bar having an upper edge defined in part by portions inclined at an acute angle relative to the horizontal length thereof, said slide bar and striker edge portions matching to provide means to vertically position said striker bar when said slide bar is slidably displaced.

11. A door locking device according to claim 10 including:

a locking lever having an inner and an outer end, the lever inner end being attached to said slider bar, the outer end extending exteriorly of said threshold whereby movement of said locking lever longitudinally displaces said slide bar between said first and second positions.

* * * * *